US007681983B2

(12) United States Patent
Kadota et al.

(10) Patent No.: US 7,681,983 B2
(45) Date of Patent: Mar. 23, 2010

(54) IMAGE FORMING APPARATUS AND VIBRATION PREVENTION MECHANISM OF A CARRIAGE

(75) Inventors: Shuichi Kadota, Fukuoka (JP); Kazuhiko Tsuyama, Kitakyushu (JP); Hiromichi Kitsuki, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 409 days.

(21) Appl. No.: 11/732,788

(22) Filed: Apr. 4, 2007

(65) Prior Publication Data

US 2007/0229590 A1 Oct. 4, 2007

(30) Foreign Application Priority Data

Apr. 4, 2006 (JP) ..... 2006-103445

(51) Int. Cl.
*B41J 23/00* (2006.01)

(52) U.S. Cl. ..... 347/37; 347/49; 347/32

(58) Field of Classification Search ..... 347/14, 347/32, 66, 37, 49; 400/319–320, 354, 352
See application file for complete search history.

(56) References Cited

U.S. PATENT DOCUMENTS 5,332,321 A * 7/1994 Beauchamp et al. ..... 400/354
5,466,077 A * 11/1995 Movaghar et al. ..... 400/354
5,657,057 A 8/1997 Nakajima et al.
6,880,993 B2 4/2005 Nellen et al.

FOREIGN PATENT DOCUMENTS

| | | |
|---|---|---|
| JP | 05-278228 | 10/1993 |
| JP | 09-202016 | 8/1997 |
| JP | 2003-158614 | 5/2003 |
| JP | 2004-034563 | 2/2004 |
| JP | 2004155190 | 6/2004 |
| JP | 2004-268336 | 9/2004 |
| JP | 2004-338105 | 12/2004 |

* cited by examiner

*Primary Examiner*—Juanita D Stephens
(74) *Attorney, Agent, or Firm*—Nutter Mc Clennen & Fish LLP; John J. Penny, Jr.

(57) ABSTRACT

An image forming apparatus having a print head that reciprocates along a guide rail includes a carriage on which the print head is mounted. The print head is supplied with ink through a tube from an ink cartridge that is arranged outside the carriage. The carriage includes an engaging portion that slidably engages the carriage with the guide rail, an urging portion that presses the guide rail against the engaging portion, and a base portion on which the urging portion is mounted. The urging portion includes an elastic member that is in contact with the base portion at one end thereof, and a wedge-shaped member that is connected to the other end of the elastic member and urged in a direction in which the guide rail is pressed against the engaging portion by the elastic force of the elastic member.

5 Claims, 6 Drawing Sheets

IMAGE FORMING APPARATUS AND VIBRATION PREVENTION MECHANISM OF A CARRIAGE

BACKGROUND

1. Technical Field

The present invention relates to a technology for an image forming apparatus and more particularly to a technology for transporting a carriage on which a print head is mounted.

2. Related Art

In general, an ink jet printer is provided with a carriage on which a print head is mounted for discharging ink, and a carriage drive mechanism that slidably supports the carriage by means of a guide shaft and allows the carriage to reciprocate along the guide shaft. The carriage may vibrate (swing) due to the moment of force that is applied when the carriage accelerates or decelerates during its reciprocating movement. The swinging of the carriage causes poor printing quality.

JP-A-2003-158614 describes a technology that reduces a possibility that the swinging of a carriage can occur. JP-A-2003-158614 discloses an image reader having an image sensor that reads a document put on a flatbed, a carriage on which the image sensor is mounted, and a guide shaft for allowing the carriage to move. The carriage is provided with a stationary slide member and a pressing slide member, which engage the guide shaft. The stationary slide member is in contact with the guide shaft and thereby positioned in a direction perpendicular to a direction in which the stationary slide member moves. The stationary slide member and the pressing slide member, which is pressed by a pressing spring from a side opposite to the stationary slide member, clamp the guide shaft. In this manner, when a load is applied due to the movement of the carriage, swinging of the carriage is prevented by the urging force that results from the contact of the stationary slide member with the guide shaft and the pressing force applied to the guide shaft by the pressing slide member.

In recent years, printers have tended to be provided with an increased number of ink cartridges so as to produce high-quality printed images. As a result, the weight and size of a carriage on which the ink cartridges are mounted have also increased. In this trend of increasing number of ink cartridges, in order to suppress an increase in size of a printer, a printer of a type having ink cartridges that are separate from a carriage has been developed. The printer of a type having ink cartridges that are separate from the carriage has a structure in which the ink cartridges are arranged in a dead space within the body of the printer, and ink is supplied from the ink cartridges through a flow passage, such as a tube, to a print head that is mounted on the carriage.

The printer of a type having ink cartridges that are separate from the carriage, however, has a problem as described below. Specifically, the carriage will receive the moment of force due to elastic force of the tube, in addition to the moment of force due to inertial force and frictional force, which are applied to the carriage when the carriage accelerates or decelerates during its reciprocating movement. The magnitude and direction of the moment of force that the carriage receives due to the elastic force depend on a position of the reciprocating carriage. The magnitude of the moment of force due to the elastic force may be several times larger than that of the moment of inertial force that counters the moment of force. Therefore, there is a high possibility that swinging of the carriage can occur in a printer of this type.

JP-A-2003-158614 describes a technology that is directed toward preventing swinging due to the moment of force that the carriage receives during its reciprocating movement, and that does not assume that the moment of force received is several times larger than the moment of inertial force acting against that moment of force. If the technology described in JP-A-2003-158614 is applied to the printer of a type having ink cartridges that are separate from the carriage, it requires employing a large pressing spring, thus making the size of the apparatus large.

SUMMARY

An advantage of some aspects of the invention is that, in an image forming apparatus provided with a carriage on which a print head is mounted, wherein the print head is supplied with ink through a tube, vibration (swinging) of the carriage is prevented without an increase in size of the apparatus.

To solve the above problem, a first aspect of the present invention is implemented in an image forming apparatus provided with a print head that reciprocates along a guide rail.

The image forming apparatus includes a carriage on which the print head is mounted. The print head is supplied with ink through a tube from an ink cartridge that is arranged outside the carriage. The carriage includes an engaging portion that slidably engages the carriage with the guide rail, an urging portion that presses the guide rail toward the engaging portion, and a base portion on which the urging portion is mounted. The urging portion includes an elastic member that contacts the base portion at one end thereof, and a wedge-shaped member that is connected to the other end of the elastic member and urged in a direction in which the guide rail is pressed against the engaging portion by the elastic force of the elastic member.

In the above image forming apparatus, the engaging portion may have a first surface and a second surface that makes an angle with the first surface, and the wedge-shaped member may be pressed against the guide rail by the elastic force of the elastic member against both the first surface and second surface of the engaging portion.

In the above image forming apparatus, the elastic member may be a compression spring.

Alternatively, in the above image forming apparatus, the elastic member may be a leaf spring.

Furthermore, in the above image forming apparatus, the wedge-shaped member may have a plurality of projections formed on its surface facing the guide rail, and the plurality of projections may be in contact with the guide rail.

A second aspect of the present invention is implemented in a vibration prevention mechanism of a carriage on which a print head is mounted, wherein the print head reciprocates along a guide rail. The print head is supplied with ink through a tube from an ink cartridge that is arranged outside the carriage.

The vibration prevention mechanism of the carriage includes an engaging portion that slidably engages the carriage with the guide rail, an urging portion that presses the guide rail against the engaging portion, and a base portion on which the urging portion is mounted. The urging portion includes an elastic member that contacts the base portion at one end thereof, and a wedge-shaped member that is connected to the other end of the elastic member and urged in a direction in which the guide rail is pressed against the engaging portion by the elastic force of the elastic member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described with reference to the accompanying drawings.

An image forming apparatus in which a first exemplary embodiment of the invention is implemented will be schematically described with reference to FIG. 1. Note that, in the first exemplary embodiment, the image forming apparatus is an ink jet printer. The image forming apparatus according to the first exemplary embodiment is a printer of a type having ink cartridges (ink tanks) that are not mounted on a carriage on which a print head for discharging ink is mounted. That is, the image forming apparatus is a printer of a type having ink cartridges that are arranged in a dead space, or the like, within the body of the printer, and ink is supplied from the ink cartridges to the print head through a flow passage, such as a tube.

The image forming apparatus according to the first exemplary embodiment is provided with a mechanism for preventing vibration of the carriage on which the print head is mounted. Note that components other than the mechanism for preventing vibration of the carriage (for example, a controller of the printer, a paper feed and discharge mechanism, or the like) may be implemented by the known art. For this reason, of the components of the image forming apparatus, only the components of the mechanism for preventing vibration of the carriage will be specifically described, and a description of the other components is omitted.

Figure 1A:
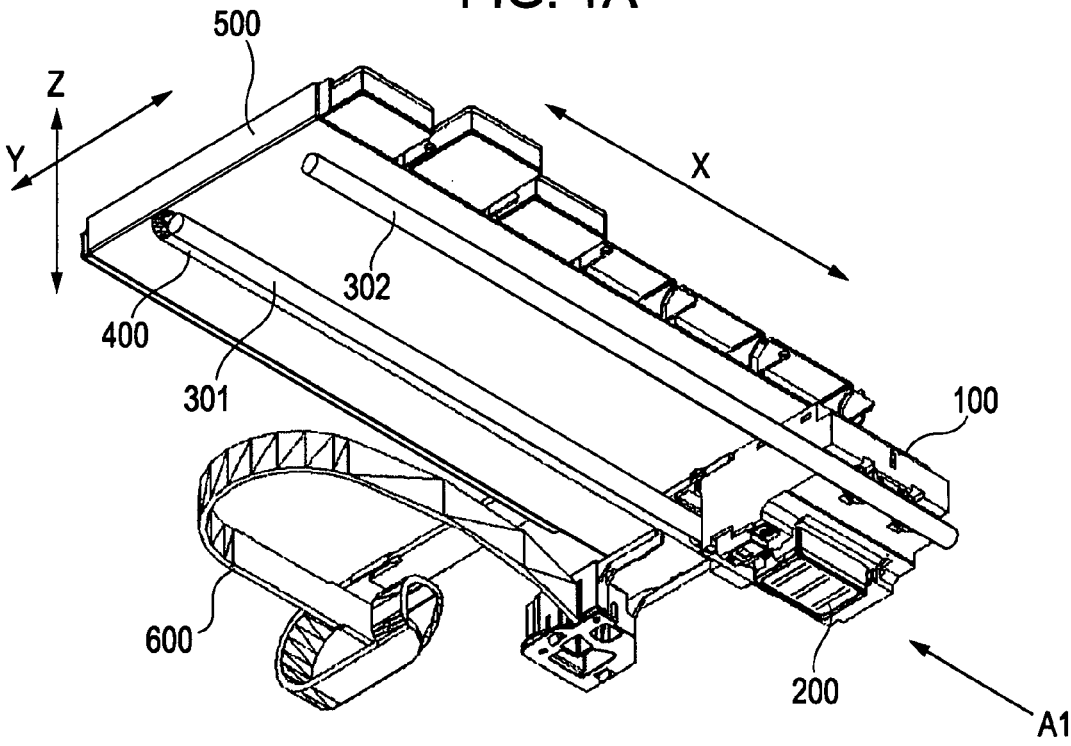
FIG. 1A is a schematic perspective view of a carriage transport mechanism, as viewed from the lower side, according to a first exemplary embodiment of the invention.
Figure 1B:
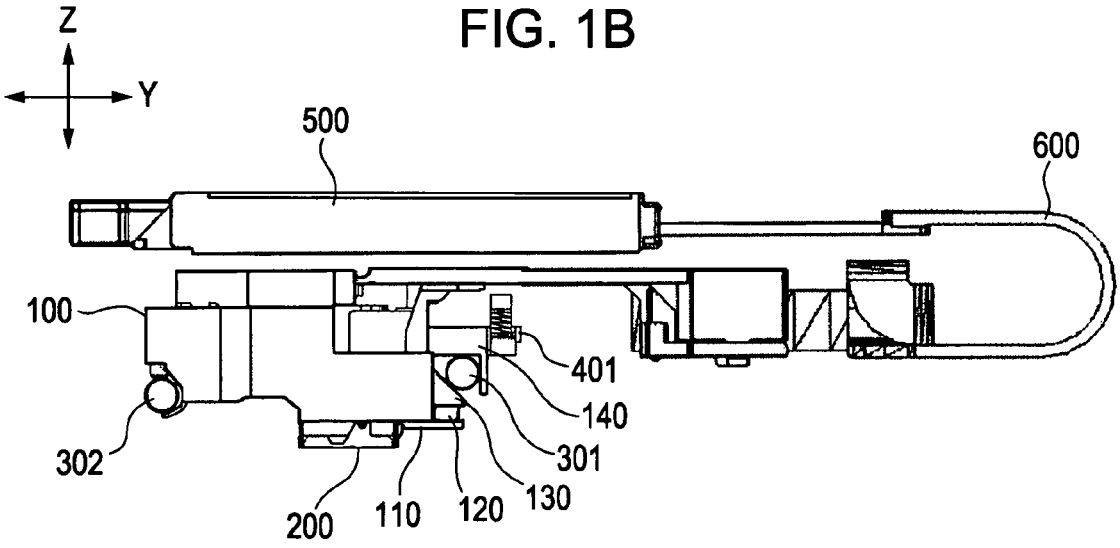
FIG. 1B is a schematic side end view of the carriage transport mechanism, as viewed in the direction indicated by an arrow A1 in FIG. 1A, according to the first exemplary embodiment of the invention.

FIG. 1A is a schematic perspective view of a carriage transport mechanism of the image forming apparatus, as viewed from the lower side, according to the first exemplary embodiment. FIG. 1B is a schematic side end view (YZ plan view) of the carriage transport mechanism, as viewed in the direction indicated by an arrow A1 in FIG. 1A, according to the first exemplary embodiment of the invention.

Figure 2:
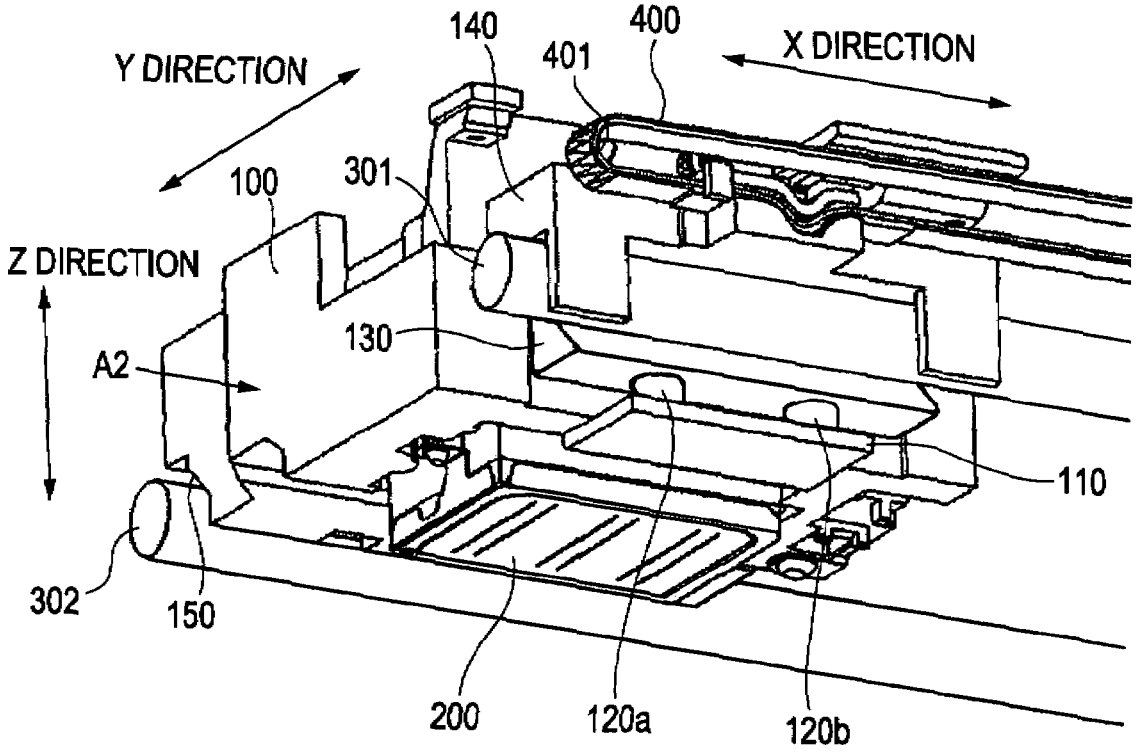
FIG. 2 is a perspective view of a carriage and guide shafts, as viewed from the lower side, according to the first exemplary embodiment of the invention.

As shown in FIG. 1 and FIG. 2, the carriage transport mechanism includes a carriage 100 on which a print head 200 is mounted for discharging ink, guide shafts 301, 302 that support the carriage 100, a drive motor (not shown), a drive pulley (not shown) that is connected to the output shaft of the drive motor and provided adjacent to one end of the body of the image forming apparatus, a driven pulley 401 that is provided opposite the drive motor and adjacent to the other end of the body of the image forming apparatus, and a timing belt 400 that is connected to the carriage 100 and wound between the drive pulley and the driven pulley 401. The carriage 100 is supported on the two guide shafts 301, 302 (or guide rails) and reciprocates in the axial direction of the guide shafts 301, 302 (X direction) under power of the drive motor (not shown).

Specifically, a transport target (herein, the print head 200) is mounted on the carriage 100. The guide shaft 301 (primary shaft) and the guide shaft 302 (secondary shaft) support the carriage 100 and guide the carriage 100 when the carriage 100 moves. The timing belt 400 transmits driving force of the drive motor (not shown), which is a drive source, to the carriage 100. The driven pulley 401 supports the timing belt 400. The drive pulley (not shown) is connected to the output shaft of the drive motor (not shown) and transmits driving force of the motor to the timing belt 400.

Ink cartridges 500 that each contain ink are provided separate from the carriage 100. That is, the ink cartridges 500 are not mounted on the carriage 100. The ink cartridges 500 are arranged in a dead space within the body of the image forming apparatus. The ink contained in each of the ink cartridges 500 is supplied to the print head 200 through a flow passage that is formed of a tube 600, or the like.

The carriage 100 receives the moment of force due to elastic force of the tube 600 in addition to the moment of force applied when the carriage 100 accelerates or decelerates during its reciprocating movement. That is, the elastic force of the tube 600 displaces the carriage 100. In particular, the moment of force due to the elastic force of the tube 600 is larger than the moment of inertial force that counters the moment of force. For this reason, in this exemplary embodiment, components (110, 120, 130, 140) are provided for preventing swinging of the carriage 100 when the carriage 100 receives the moment of force due to the elastic force of the tube 600 in addition to the moment of force that is applied when the carriage 100 accelerates or decelerates during its reciprocating movement. The components for preventing swinging of the carriage 100 will be described with reference to FIG. 2 and FIG. 3.

Figure 3:
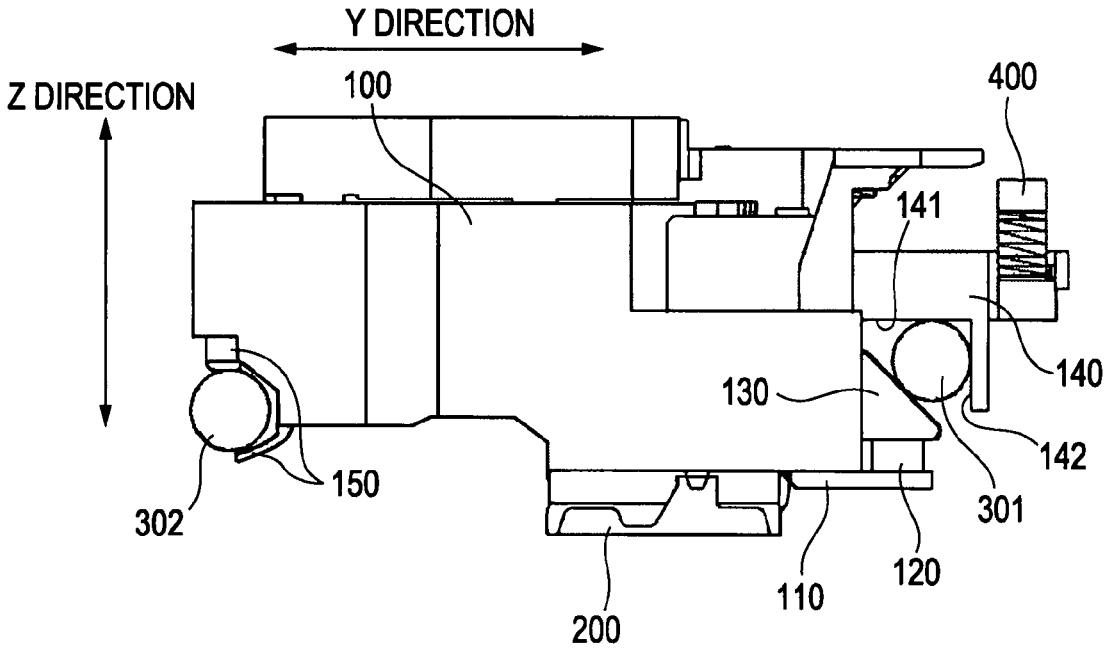
FIG. 3 is a side end view of the carriage and guide shafts as viewed in the direction indicated by an arrow A2 in FIG. 2, according to the first exemplary embodiment of the invention.

FIG. 2 is a perspective view of the carriage and guide shafts, as viewed from the lower side, according to the first exemplary embodiment. FIG. 3 is a side end view (YZ plan view) of the carriage and guide shafts as viewed in the direction indicated by an arrow A2 in FIG. 2, according to the first exemplary embodiment.

As shown in FIG. 2 and FIG. 3, the carriage 100 includes a first engaging portion 140 that slidably engages the carriage 100 with the guide shaft 301, a second engaging portion 150 that slidably engages the carriage 100 with the guide shaft 302, an urging portion (120*a*, 120*b*, 130) that presses the guide shaft 301 against the first engaging portion 140, and a base portion 110 on which the urging portion (120*a*, 120*b*, 130) is mounted.

As shown in FIG. 3, the first engaging portion 140 has an L-shape, and has a first surface 141 and a second surface 142 that is formed substantially perpendicularly to the first surface 141.

The urging portion includes compression springs 120*a*, 120*b* that are each in contact with the base portion 110 at one end thereof, and a wedge-shaped slide member 130 that is connected to the other end of each of the compression springs 120*a*, 120*b* and urged in a direction in which the guide shaft 301 is pressed against both the first surface 141 and second surface 142 of the first engaging member 140 by the elastic force of the compression springs 120*a*, 120*b*.

Note that the second engaging portion 150 is only required to engage the carriage 100 with the guide shaft 302 so as to be slidable in the axial direction (X direction), and the structure of the second engaging portion 150 is not specifically limited.

In association with utilization of the wedge-shaped slide member 130, the compression springs 120*a*, 120*b* should be capable of imparting an elastic force of a magnitude that swinging of the carriage 100 can be prevented when the carriage 100 receives both the moment of force that is applied when the carriage 100 accelerates or decelerates during its reciprocating movement and the moment of force due to the elastic force of the tube 600.

With the above-described structure, the carriage 100 is able to reciprocate in the axial direction while being supported by the two guide shafts 301, 302. In addition, the guide shaft 301 is urged by the urging portion toward the first engaging portion 140, so that swinging of the carriage may be prevented.

The following will describe why the compression springs 120*a*, 120*b*, and the wedge-shaped slide member 130 are utilized as the urging portion. Specifically, in the known art, for example, as described in JP-A-2003-158614, elastic force of a spring has been utilized for preventing swinging of the carriage 100, the swinging being caused by the moment of force that is generated when the carriage 100 accelerates or decelerates. However, the carriage 100 according to this exemplary embodiment receives the moment of force due to the elastic force of the tube 600 in addition to the moment of force that is generated when the carriage 100 accelerates or decelerates during its reciprocating movement. When the manner according to the known art is employed, that is, only elastic force of a spring is utilized (a spring and a plate slide member are utilized) so as to prevent swinging of the carriage 100, the spring is required to impart a larger elastic force. If prevention of swinging of the carriage is intended only with the structure according to the known art, the size of the spring must be increased, resulting in an increase in size of the image forming apparatus. In this exemplary embodiment, the wedge-shaped slide member 130 is utilized (according to the principle of a wedge) to counter the moment of force due to the elastic force of the tube 600 without utilizing a large-sized spring.

The wedge-shaped slide member 130 according to this exemplary embodiment will be described with reference to FIGS. 4 to 6.

Figure 4:
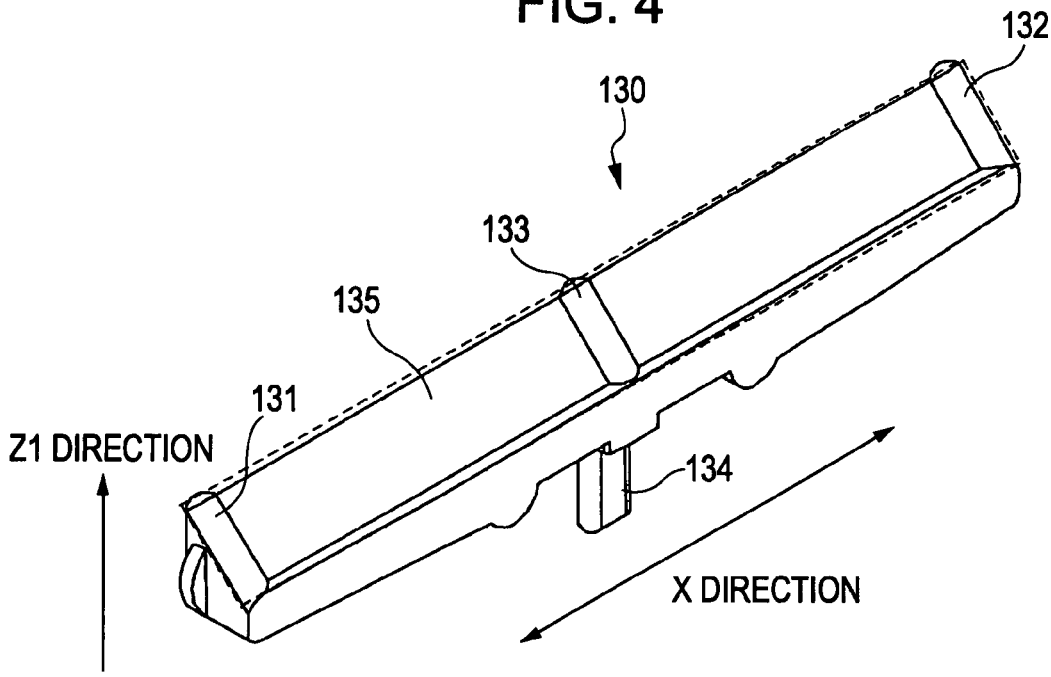
FIG. 4 is a schematic perspective view of a slide member that is utilized for preventing vibration of the carriage according to the first exemplary embodiment of the invention.

FIG. 4 is a schematic perspective view of the slide member that is utilized for preventing vibration of the carriage according to this exemplary embodiment, as viewed from the upper side of the slide member. FIG. 5 is an enlarged side end view of the slide member according to this exemplary embodiment.

Figure 5:
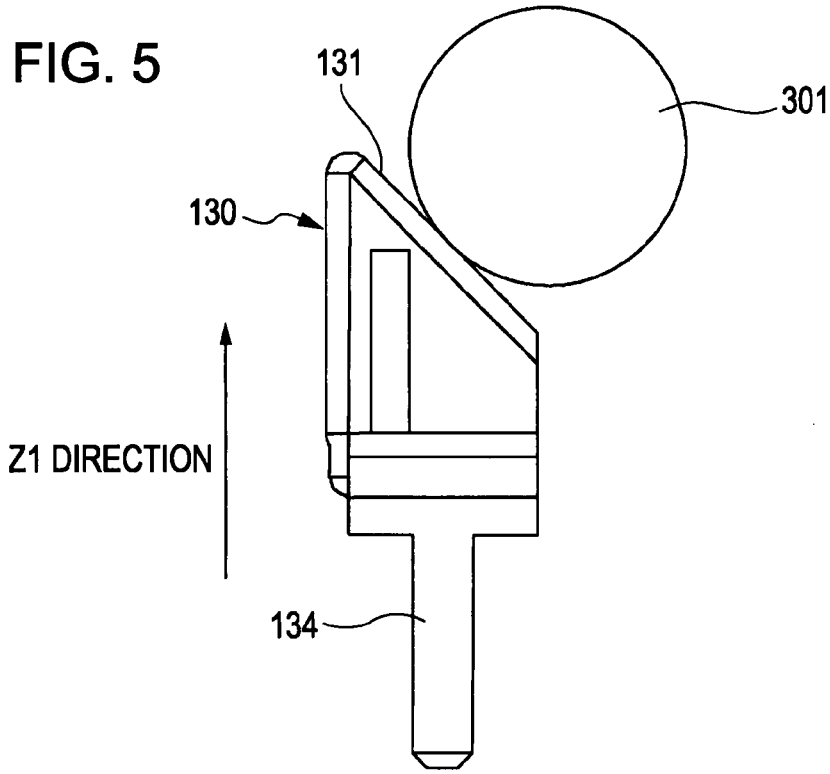
FIG. 5 is an enlarged side end view of the slide member according to the first exemplary embodiment of the invention.

As shown in FIG. 4 and FIG. 5, a positioning boss 134 is formed on the lower surface of the slide member 130. The boss 134 is fitted in a hole (not shown) that is formed in the base portion 110 so that the boss 134 is slidable in the Z direction. Thus, the slide member 130 is positioned in the X direction.

The wedge-shaped slide member 130 has a facing surface 135 (which is the surface surrounded by a broken line in FIG. 4) that faces the guide shaft 301. Substantially semi-cylindrical (or semi-columnar) projecting portions 131, 132 are formed at both ends of the facing surface 135, respectively. Note that the height of the projecting portion 131 from the facing surface 135 is the same as the height of the projecting portion 132 from the facing surface 135. In addition, in order to restrict flexure of the slide member 130, a substantially semi-cylindrical (or semi-columnar) projecting portion 133 is formed at the middle of the facing surface 135. Note that the height of the projecting portion 133 from the facing surface 135 is sufficiently lower than the height of the projecting portion 131 (or 132) from the facing surface 135. The projecting portions 131, 132 formed on the facing surface 135 of the slide member 130 are in contact with the guide shaft 301, as shown in FIG. 5. That is, by receiving the elastic force from the compression springs 120*a*, 120*b* (see FIG. 2) in the Z1 direction, the projecting portions 131, 132 are made to be in contact with the guide shaft 301. Then, a state where the slide member 130 is in contact with the guide shaft 301 is shown in FIG. 6.

Figure 6:
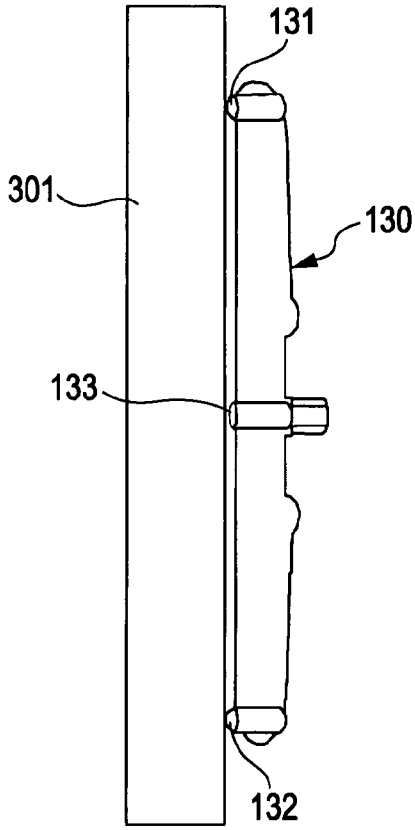
FIG. 6 is a view that illustrates a state where projecting portions of the slide member are in contact with the guide shaft according to the first exemplary embodiment of the invention.

FIG. 6 is a view that illustrates a state where the projecting portions of the slide member are in contact with the guide shaft according to this exemplary embodiment.

The two projecting portions 131, 132 formed on the slide member 130 are in contact with the guide shaft 301. The guide shaft 301 is urged by the load from the two projecting portions 131, 132 in a direction in which the guide shaft 301 is pressed against the engaging portion 140. In addition, flexure of the slide member 130 is restricted by the projecting portion 133 formed at the middle of the slide member 130. By providing the projecting portion 133 at the middle of the slide member 130, the slide member 130 need not be formed of a member having a high Young's modulus. Thus, costs of the slide member may be reduced.

According to the first exemplary embodiment, the wedge-shaped slide member 130, as well as the compression springs 120*a*, 120*b*, is used as the urging portion. By utilizing the wedge-shaped slide member 130, compression springs, each having a smaller size, are able to prevent swinging of the carriage 100. That is, according to this exemplary embodiment, by the combination of the compression springs 120*a*, 120*b* and the wedge-shaped slide member 130, the mechanism for preventing swinging of the carriage may be implemented with form having a small volume.

Thus, according to the first exemplary embodiment, in the image forming apparatus provided with the carriage on which the print head is mounted, wherein the print head is supplied with ink through the tube, swinging of the carriage 100 may be prevented without an increase in size of the apparatus.

Furthermore, by forming the slide member 130 in a wedge shape, the urging portion may be placed to apply an urging force in a direction that is different from a direction in which the guide shaft 301 is urged. Thus, the freedom of design may be improved. In addition, according to this exemplary embodiment, the size of the compression springs may be reduced, so that production cost may be reduced.

A second exemplary embodiment according to the invention will be described. Some of the components in the above-described first exemplary embodiment are modified in the second exemplary embodiment. Specifically, the compression springs are utilized for urging the slide member 130 in the first exemplary embodiment, whereas the compression springs 120*a*, 120*b* are replaced by a plate spring in the second exemplary embodiment. In the description of the second exemplary embodiment, like reference numerals are used to denote like components described in the first exemplary embodiment.

The carriage transport mechanism of an image forming apparatus according to the second exemplary embodiment is the same as that shown in FIG. 1A. In other words, the image forming apparatus according to the second exemplary embodiment is also a printer of a type having the ink cartridges 500 that are not mounted on the carriage 100.

The components for preventing swinging of the carriage 100 according to the second exemplary embodiment will now be described with reference to FIG. 7 and FIG. 8.

Figure 7:
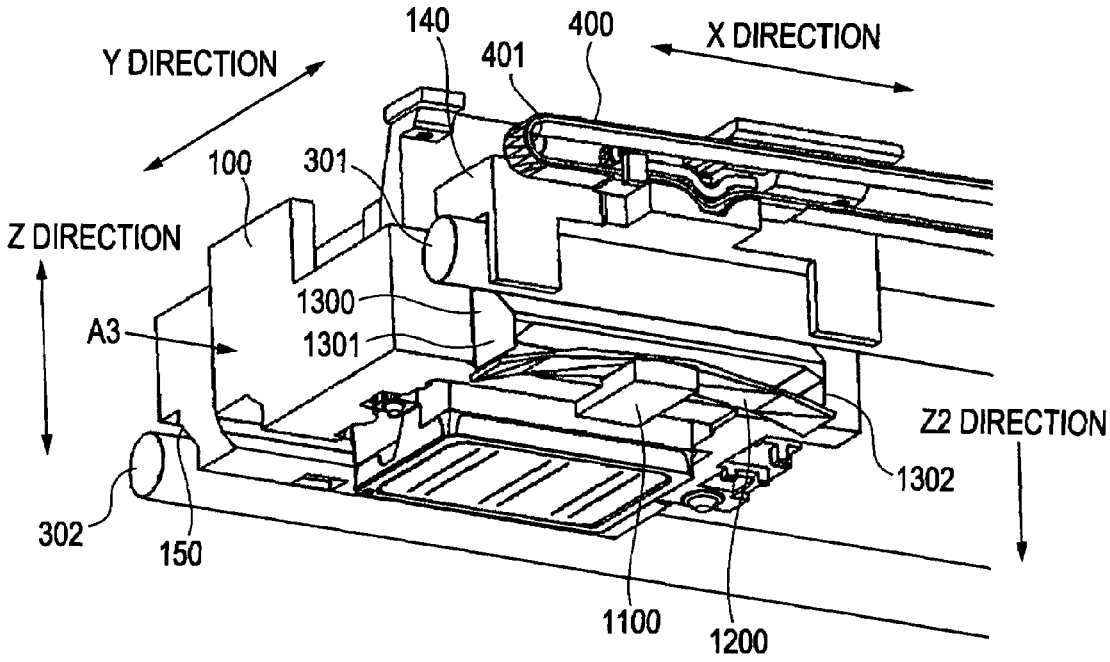
FIG. 7 is a perspective view of a carriage and guide shafts, as viewed from the lower side, according to a second exemplary embodiment of the invention.

FIG. 7 is a perspective view of the carriage and guide shafts, as viewed from the lower side, according to the second exemplary embodiment. FIG. 8 is a side end view (YZ plan view) of the carriage and guide shafts, as viewed in the direction indicated by an arrow A3 in FIG. 7, according to the second exemplary embodiment. Note that portions of the second exemplary embodiment different from those of the first exemplary embodiment will be specifically described below.

Figure 8:
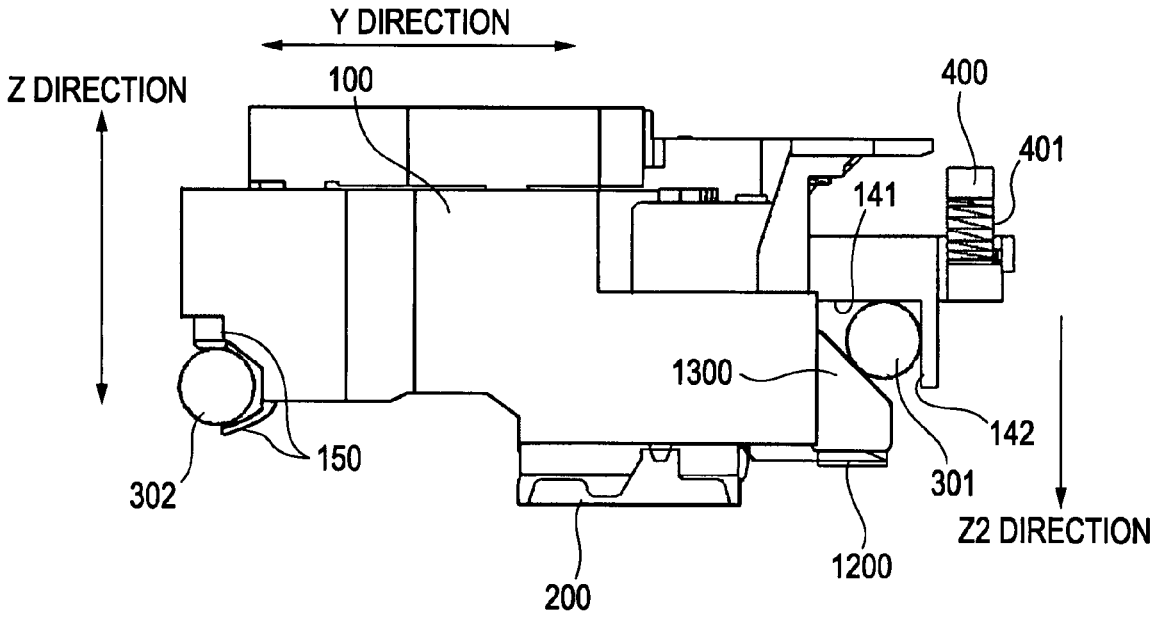
FIG. 8 is a side end view of the carriage and guide shafts, as viewed in the direction indicated by an arrow A3 in FIG. 7, according to the second exemplary embodiment of the invention.

As shown in FIG. 7 and FIG. 8, the carriage 100 includes a first engaging portion 140 that slidably engages the carriage 100 with the guide shaft 301, a second engaging portion 150 that slidably engages the carriage 100 with the guide shaft 302, an urging portion (1200, 1300) that presses the guide shaft 301 against the first engaging portion 140, and a base portion 1100 on which the urging portion (1200, and 1300) is mounted.

The urging portion (1200, 1300) and the shape of the base portion 1100 in the second exemplary embodiment differ from those in the first exemplary embodiment. Other than that, the components of the second exemplary embodiment are the same as those in the first exemplary embodiment.

Specifically, the urging portion has a plate spring 1200 and a wedge-shaped slide member 1300 that is urged by the elastic force of the plate spring 1200 in a direction in which the guide shaft 301 is pressed against both the first surface 141 and second surface 142 of the first engaging portion 140, as shown in FIG. 8.

The base portion 1100 is a plate member that fixes substantially the middle portion of the plate spring 1200 in place. The length of the base portion 1100 in the X direction is sufficiently smaller than the length of the plate spring 1200 in the X direction. This is because a space for flexure of the plate spring 1200 needs to be ensured.

The wedge-shaped slide member 1300 is the same as the slide member 130 of the first exemplary embodiment, other than the shape of the lower face portion thereof. Specifically, the lower face portion of the slide member 1300 receives a load that is applied from the opposite ends of the plate spring 1200. For this reason, plate projections 1301, 1302 are formed at the opposite ends of the lower face portion of the slide member 1300.

The plate spring 1200 is placed so that substantially the middle portion of a flat-shaped plate member is fixed to the base portion 1100 and the opposite ends of the plate member are bent downward (in the Z2 direction). Then, the projections 1301, 1302 of the slide member 1300 are connected to the opposite ends of the plate spring 1200, respectively. The slide member 1300 is urged in the direction in which the guide shaft 301 is pressed against the first engaging portion as the projections 1301, 1302 receive a load from the plate spring 1200.

According to the second exemplary embodiment, because the wedge-shaped slide member 1300 is utilized as the urging portion, the same advantageous effects as those of the first exemplary embodiment may also be obtained.

In the second exemplary embodiment, because the plate spring 1200 is utilized in place of the compression springs 120*a*, 120*b*, the size of the structure for preventing swinging of the carriage 100 may be further reduced in comparison with that of the first exemplary embodiment.

The invention is not limited to the exemplary embodiments described above, but it may be modified into various forms within the scope of the invention.

In the description of the above exemplary embodiments, the compression springs 120*a*, 120*b* or the plate spring 1200 is utilized as the component of the urging portion, for example. However, this is merely an illustrative example. Any elastic member that is able to apply a load to the wedge-shaped slide member 130 (or 1300) is applicable.

In the first exemplary embodiment, two compression springs 120*a*, 120*b* are utilized as the elastic member. However, this is merely an illustrative example. The number of the compression springs may be changed.

In the description of the above exemplary embodiments, an example was illustrated in which the printer of a type having the ink cartridges 500 that are separate from the carriage 100 on which the print head 200 is mounted, wherein ink is supplied to the print head through the tube 600, but the invention is not limited to this. The invention may be applied to a printer of a type having ink cartridges that are mounted on a carriage. In this case as well, because the wedge-shaped slide member is utilized, the size of the structure for preventing swinging of the carriage may be reduced. In addition, because the urging portion may be placed to apply an urging force in a direction that is different from a direction in which the guide shaft is urged, the freedom of design may be improved.

The entire disclosure of Japanese Patent Application No. 2006-103445, filed Apr. 4, 2006 is expressly incorporated by reference herein.

What is claimed is:

1. An image forming apparatus having a print head that reciprocates along a guide rail, comprising:

a carriage on which the print head is mounted, wherein the print head is supplied with ink through a tube from an ink cartridge that is arranged outside the carriage, wherein the carriage includes:

an engaging portion that slidably engages the carriage with the guide rail;

an urging portion that presses the guide rail against the engaging portion; and a base portion on which the urging portion is mounted, and wherein the urging portion includes:

an elastic member that is in contact with the base portion at one end thereof; and a wedge-shaped member that is connected to the other end of the elastic member and urged in a direction in which the guide rail is pressed against the engaging portion by the elastic force of the elastic member;

wherein the engaging portion has a first surface, and a second surface that makes an angle with the first surface, and wherein the wedge-shaped member presses the guide rail against both the first surface and second surface of the engaging portion by the elastic force of the elastic member.

2. The image forming apparatus according to claim 1, wherein the elastic member is a compression spring.

3. The image forming apparatus according to claim 1, wherein the elastic member is a plate spring.

4. The image forming apparatus according to claim 1, wherein the wedge-shaped member has a plurality of projections formed on a surface that faces the guide rail, and wherein the plurality of projections are in contact with the guide rail.

5. A vibration prevention mechanism of a carriage on which a print head is mounted, wherein the print head reciprocates along a guide rail, the print head being supplied with ink through a tube from an ink cartridge that is arranged outside the carnage, comprising:

an engaging portion that slidably engages the carriage with the guide rail;

an urging portion that presses the guide rail against the engaging portion; and a base portion on which the urging portion is mounted, wherein the urging portion includes:

an elastic member that is in contact with the base portion at one end thereof; and a wedge-shaped member that is connected to the other end of the elastic member and urged in a direction in which the guide rail is pressed against the engaging portion by the elastic force of the elastic member;

wherein the engaging portion has a first surface, and a second surface that makes an angle with the first surface, and wherein the wedge-shaped member presses the guide rail against both the first surface and second surface of the engaging portion by the elastic force of the elastic member.

* * * * *